US009291003B2

(12) United States Patent
Sponchia et al.

(10) Patent No.: US 9,291,003 B2
(45) Date of Patent: Mar. 22, 2016

(54) ASSEMBLY AND TECHNIQUE FOR COMPLETING A MULTILATERAL WELL

(75) Inventors: Barton Sponchia, Cypress, TX (US); Gabriel Isaicu, Missouri City, TX (US); Patrick McKinley, Richmond, TX (US); Matthew C. Williams, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 662 days.

(21) Appl. No.: 13/486,098

(22) Filed: Jun. 1, 2012

(65) Prior Publication Data

US 2013/0319693 A1 Dec. 5, 2013

(51) Int. Cl.

| | |
|---|---|
| ***E21B 7/06*** | (2006.01) |
| ***E21B 10/64*** | (2006.01) |
| ***E21B 41/00*** | (2006.01) |

(52) U.S. Cl.

CPC ..... *E21B 10/64* (2013.01); *E21B 7/061* (2013.01); *E21B 41/0035* (2013.01)

(58) Field of Classification Search

CPC ..... E21B 10/64; E21B 41/0035; E21B 7/061
USPC ..... 166/117.5, 117.6, 255.2, 255.3, 384; 175/78, 79, 81
See application file for complete search history.

(56) References Cited

U.S. PATENT DOCUMENTS

| | | | | |
|---|---|---|---|---|
| 5,474,126 | A * | 12/1995 | Lynde et al. | 166/117.6 |
| 6,019,173 | A * | 2/2000 | Saurer et al. | 166/98 |
| 6,220,355 | B1 * | 4/2001 | French | 166/297 |
| 6,241,021 | B1 | 6/2001 | Bowling | |
| 6,695,056 | B2 | 2/2004 | Haugen et al. | |
| 6,923,274 | B2 | 8/2005 | Rodgers et al. | |
| 7,159,661 | B2 * | 1/2007 | Restarick et al. | 166/313 |
| 2003/0192717 | A1 * | 10/2003 | Smith et al. | 175/61 |
| 2006/0027359 | A1 * | 2/2006 | Carter et al. | 166/117.6 |
| 2009/0151588 | A1 * | 6/2009 | Burleson et al. | 102/310 |
| 2009/0288833 | A1 | 11/2009 | Graham et al. | |
| 2009/0288879 | A1 * | 11/2009 | Arena | 175/4.51 |

OTHER PUBLICATIONS

International Search Report and Written Opinion mailed on Aug. 27, 2013 for International Patent Application No. PCT/US2013/043207, filed on May 30, 2013, 15 pages.

* cited by examiner

*Primary Examiner* — Robert E Fuller
*Assistant Examiner* — David Carroll
(74) *Attorney, Agent, or Firm* — Michael Stonebrook

(57) ABSTRACT

An apparatus that is usable with a well includes an assembly, which includes a whipstock and a lateral deflector that are adapted to be run downhole into a first wellbore of the well as a unit. The whipstock is adapted to guide at least a drilling string to form a second wellbore, and the lateral deflector is adapted to guide a liner during installation of the liner into the second wellbore.

23 Claims, 6 Drawing Sheets

ASSEMBLY AND TECHNIQUE FOR COMPLETING A MULTILATERAL WELL

BACKGROUND

Wellbores drilled through the Earth's subsurface may be oriented in various directions and as such, may be vertical, deviated or horizontal wellbores. A multilateral well may have a parent wellbore and one or more lateral wellbore branches, which extend from the parent wellbore into the surrounding formation. The parent wellbore may be cased by a casing string that lines and supports the parent wellbore. Liners may line and support the lateral wellbores that extend from the parent wellbore. The casing and possibly the liners may be cemented in place in the well.

A lateral wellbore of a multilateral well may be completed after the main parent wellbore has been drilled and cased. In this manner, the lateral wellbore may be formed by running a drill string into the parent wellbore; extending the drill string through a milled or preformed opening called a "casing window" of the parent casing string; and drilling the surrounding formation. For such purposes as deflecting mills into the parent casing wall to form the casing window and guiding a drill string in the appropriate direction to form the lateral wellbore, a tool called a "whipstock" may be deployed in the parent wellbore. In this regard, the whipstock may be anchored in place in the parent wellbore below the location of the casing window so that an inclined surface of the whipstock may be used for purposes of guiding the mills and the drill string.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a technique includes running an assembly that includes a whipstock and a lateral deflector as a unit into a first wellbore of a well. The whipstock is used to guide at least a drill string to form a second wellbore. The technique includes running a liner into the second wellbore, where the running includes guiding the liner using the lateral deflector.

In another example implementation, an apparatus that is usable with a well includes an assembly, which includes a whipstock and a lateral deflector that are adapted to be run downhole into a first wellbore of the well as a unit. The whipstock is adapted to guide at least a drilling string to form a second wellbore, and the lateral deflector is adapted to guide a liner during installation of the liner into the second wellbore.

In another example implementation, an apparatus usable with a well includes a casing and a string that includes an assembly, which includes a whipstock and a lateral deflector that are adapted to be run downhole on the string. The assembly is adapted to be disengaged from the string downhole in the well and remain in the well in response to retrieval of a portion of the string uphole of the assembly, and the lateral deflector is adapted to be nested inside the whipstock when the assembly is run downhole. The whipstock includes a first surface to guide at least a milling tool to form a window in the casing, and the lateral deflector includes a second surface, which is adapted to guide installation of a liner into a lateral wellbore of the well.

In yet another example implementation, an apparatus that is usable with a well includes an assembly that is adapted to be run into the well. The assembly includes a whipstock, which includes an interior space and a lateral deflector that is disposed at least partially in the interior space. The lateral deflector includes a deflecting surface that is adapted to guide a trajectory of a liner in response to the liner being run into the well, and the lateral deflector is adapted to be releasably secured to the whipstock at least when the assembly is being run into the well. The whipstock is adapted to be released from the lateral deflector downhole in the well to allow the whipstock to be retrieved from the well and the lateral deflector to remain in the well. The lateral deflector includes at least one opening, which is preexisting before the assembly is run downhole to communicate fluid such that when the whipstock is released from the lateral deflector, the lateral deflector is adapted to communicate fluid through the at least one opening.

Advantages and other features will become apparent from the following drawings, description and claims.

DETAILED DESCRIPTION

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein to form and complete a deviated, or lateral wellbore branch of a multilateral completion. The "completion" of the lateral wellbore includes one or more of the following: milling a casing window of a parent wellbore; drilling the lateral wellbore; installing a liner in the lateral wellbore; and breaching any well fluid communication barriers in the parent wellbore, which may otherwise exist due to the assemblies/techniques that are employed to complete the lateral wellbore.

More specifically, as disclosed in more detail below, systems and techniques are disclosed herein to form a multilateral completion in a process that includes using a deflection assembly inside a parent wellbore to guide the trajectory of the drilling assembly for purposes of drilling a lateral wellbore; using the deflection assembly to further aid in the installation of a liner by guiding the trajectory of the liner into the lateral wellbore; and after the liner is installed, perforating the deflection assembly to permit fluid communication between regions above and below the deflection assembly. It is noted that without loss of generality, the multilateral completion may be, as examples, a Technology Advancement of Multilaterals (TAML) level three (L3) or level four (L4) completion.

Figure 1:
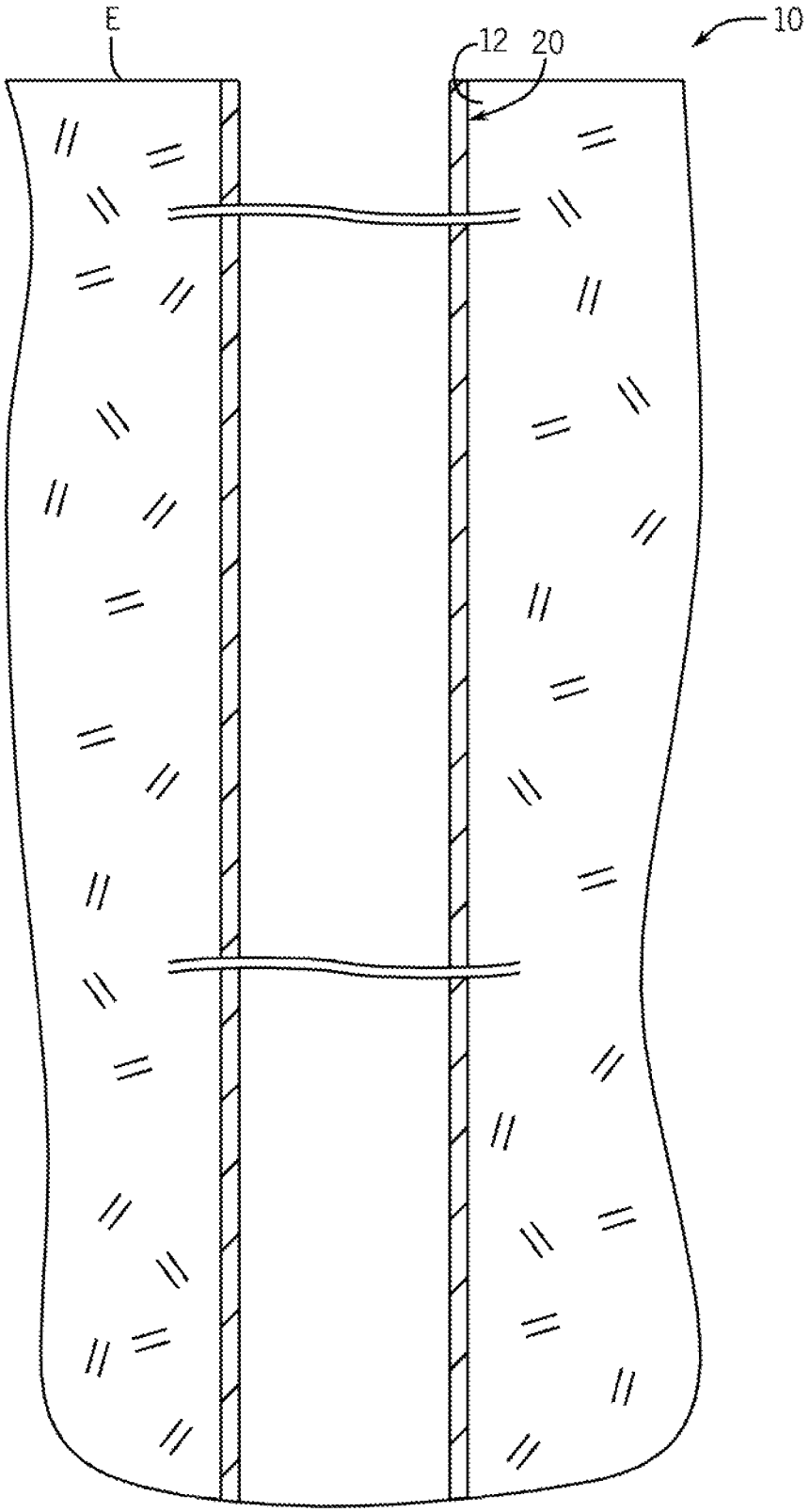
FIG. 1 is a schematic diagram of a parent wellbore of a multilateral well according to an example implementation.

As a more specific example, FIG. 1 generally depicts an initial stage in the completion of a multilateral well 10. In this stage, the well 10 includes a parent wellbore 12 (a vertical wellbore, for this example) that extends from the Earth surface E downhole through one or more formations. The multilateral well 10 may be a land-based or subsea well, depending on the particular implementation. As depicted in FIG. 1, the parent wellbore 12 is cased by a casing string 20, which lines and supports the wellbore 12. Although not specifically depicted, the casing string 20 may be cemented in place inside the wellbore 12. Thus, for the state of the multilateral well 10 depicted in FIG. 1, the parent wellbore 12 has been drilled, and the casing string 20 has been run downhole into the wellbore 12 and cemented in place.

The next phase in the multilateral completion for this example involves forming an opening, called a "casing window," in the casing string 20 at a location where a deviated, or lateral, wellbore is to extend from the parent wellbore 12. The precise location of the lateral wellbore may be derived considering a number of different factors, including measurements acquired by logging operations (operations that involve the use of acoustic, resistive, nuclear magnetic resonance (NMR) tools, and so forth) in the parent wellbore 12, geologic surveys (vibroseis seismic surveys, wellbore surveys, as examples) of the surrounding formations, and so forth.

Figure 4:
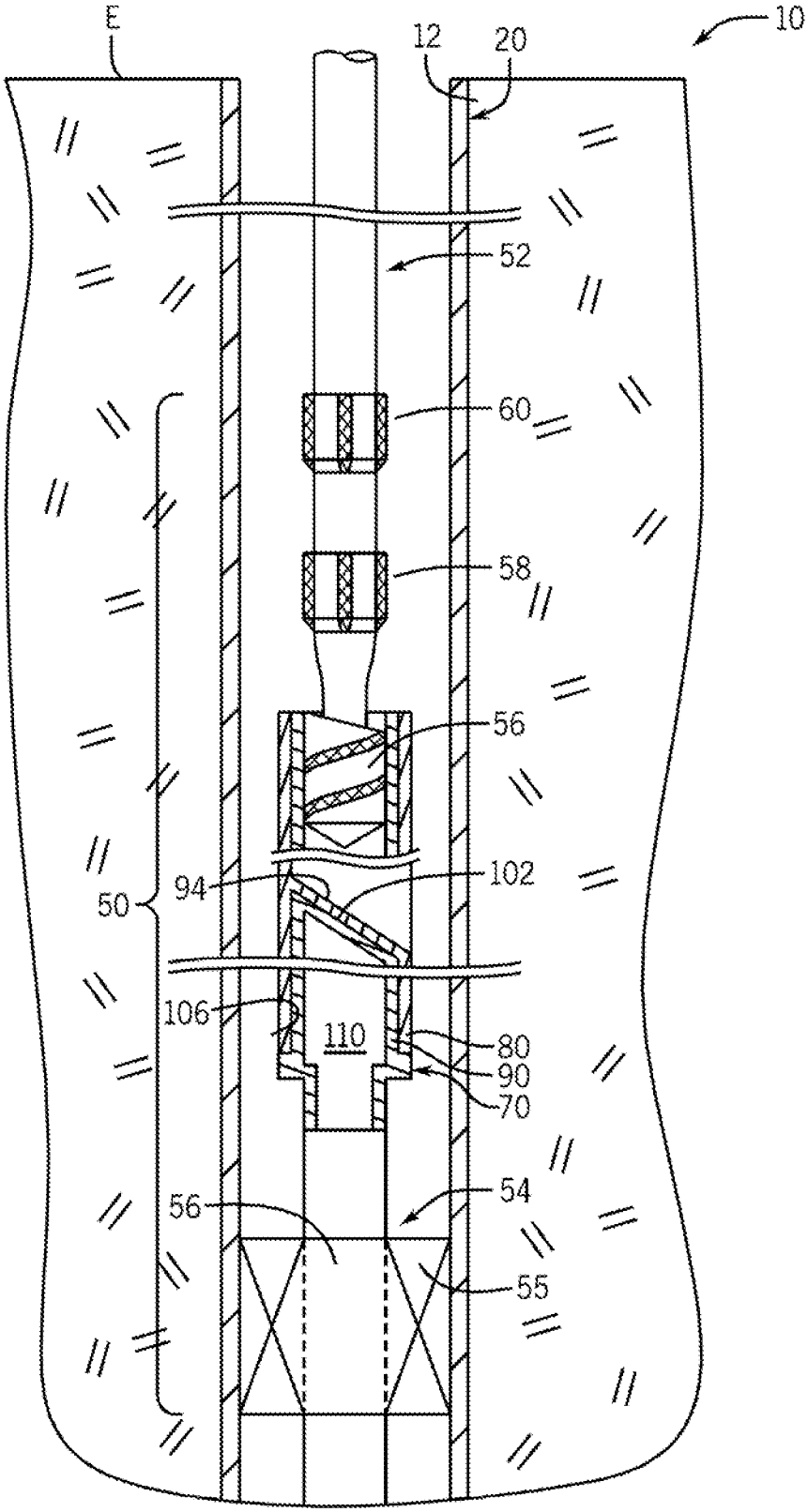
FIG. 4 is a schematic diagram illustrating the running of a milling assembly containing a whipstock and a lateral deflector into the parent wellbore according to an example implementation.

Referring to FIG. 4 in conjunction with FIG. 1, as a more specific example, in accordance with some implementations, a tool assembly (called a "milling assembly 50" herein) may be run downhole from the Earth surface E on conveyance mechanism, such as a tubing string 52, inside the parent wellbore 12 and positioned near the location where the lateral wellbore is to be formed. The milling assembly 50 for this example includes the following components that are run downhole together as a unit: mills 56, 58 and 60; a deflecting assembly 70 that is disposed below, or downhole of the mills 56, 58 and 60; and a packer 54 that is located at the downhole end of the assembly 50.

The packer 54 is set downhole to anchor, or secure, the deflection assembly 70 to the casing string 20. The deflecting assembly 70 guides, or directs, the mills 56, 58 and 60 into the wall of the casing string 20 for purposes of milling a window in the casing string 20 to form the opening, or entrance, in the parent wellbore 12 for the lateral wellbore. As further described herein, the deflecting assembly 70, in accordance with example implementations that are disclosed herein, further guides, or directs, the trajectory of a drilling string through the milled casing window to form the lateral wellbore and further guides, or directs, the trajectory of a lateral liner as the liner is being deployed into the lateral wellbore.

Turning now to the more specific details, the milling assembly 50 is run downhole via the tubing string 52 through the central passageway of the casing string 20 until a deflecting face of the deflecting assembly 70 is at the appropriate position (below, for example) to deflect the mills 56, 58 and 60 into the parent casing string 20 at the location where the casing window is to be milled. The downhole position of the milling assembly 50 may be determined by monitoring the length of the deployed string for the Earth surface E, using casing collar locators, using sensors, and so forth.

When the deflecting assembly 70 at the appropriate downhole position, the packer 54 is set. In its set state, the packer 54 expands its radial sealing element(s) 55 to form an annular fluid seal between the exterior of the tubing string 52 and the interior of the casing string 20. The packer 54 also mechanically secures the deflecting string 52 in position via slips, or dogs (not shown), which extend from the packer 54 into the parent casing string 20. In accordance with exemplary implementations disclosed herein, fluid communication through the central bore 56 of the packer 54 is at least initially closed off uphole of the packer 54 due to the deflecting assembly 50, as further discussed below. The packer 54 may be one of many different types of packers, depending on the particular implementation, such as a weight-set packer, hydraulically-set packer, mechanically-set packer, and so forth.

FIG. 4 generally depicts the milling assembly 50 in its run-in-hole state, a state in which the mills 56, 58 and 60 of the milling assembly 50 are fixed in position relative to the deflecting assembly 70 and the remaining components of the string 52. After the packer 54 is set and thus, after the deflection assembly 70 is in the appropriate downhole position, the mills 56, 58 and 60 are constructed to be released so that the mills 56, 58 and 60 may be manipulated in position (via the tubing string 52) relative to the deflecting assembly 70 that is now anchored to the casing string 20. As examples, the mills 56, 58 and 60 may be initially secured to the deflecting assembly 70 using a releasable mechanism, such as shear screws, a collet, a snap latch, and so forth, as can be appreciated by the skilled artisan.

In general the mills 56, 58 and 60 contain abrasive cutting elements that are disposed on lands of the mills 56, 58 and 60, as well as fluid communication channels, for purposes of milling out the casing string 20 to form the casing window. The mills 56, 58 and 60 may be driven, or rotated, via one of numerous techniques/mechanisms, as can be appreciated by the skilled artisan, such as techniques that include pumping fluid through the central passageway of the tubing string 52 to drive downhole fluid motors, for example. After the mills 56, 58 and 60 are released from their secure run-in-hole positions, downhole travel of the tubing string 52 causes the mills 56, 58 and 60 to engage a hardened, deflecting face 94 of the deflecting assembly 70, and this engagement, in turn, causes the mills 56, 58 and 60 to deviate away from the longitudinal axis of the casing string 20 and toward the casing string wall for purposes of milling out the casing window.

As depicted in FIG. 4, as a non-limiting example, the farthest mill 56 downhole may be a pilot mill that includes lands and fluid routing channels for purposes of forming an initial pilot hole in the casing string wall. The mill 58, disposed uphole of the pilot mill 56, may be a gauge mill, which forms the overall rough dimensions of the casing window. The mill 60, in turn, is located uphole of the gauge mill 58 and may be a reamer mill 60 to mill the casing window to its final dimensions. It is noted that FIG. 4 is merely depicts an example schematic illustration of a milling assembly, in that the string 52 may contain more than three or less than three mills; the mills may have different constructions and features; and so forth, depending on the particular implementation.

In further implementations, the deflecting assembly 70 and the packer 54 may be run downhole as an assembly on the tubing string 52 (or other conveyance device) without any mills. For example, in accordance with some implementations, a casing window may be milled in the parent casing string 20 using a milling tool assembly that is run downhole in a separate trip before the deflecting assembly 70 and the packer 54 are run downhole. As another example, in some implementations, the parent casing string 20 may be installed with a casing window that is already preformed in the appropriate section of the casing string 20, thereby obviating the casing window milling process altogether. Thus, many variations are contemplated, which are within the scope of the appended claims.

Figure 5:
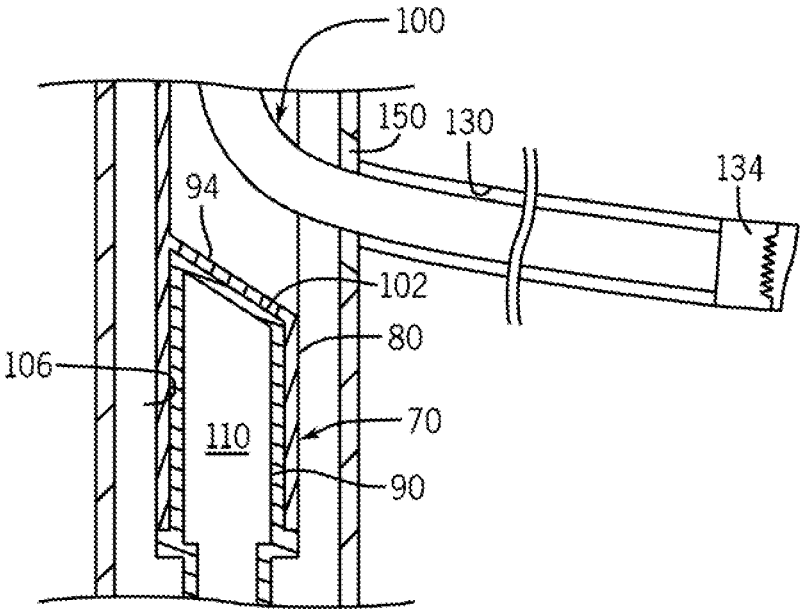
FIG. 5 is a schematic diagram illustrating drilling of the lateral wellbore using the whipstock to guide the trajectory of a drill string according to an example implementation.

Regardless of how the casing window is formed, the next phase in the multilateral completion disclosed herein is the drilling of the lateral wellbore. Referring to FIG. 5 in conjunction with FIG. 4, the casing string 20 is depicted as containing a casing window 150 (a milled or preformed casing window, depending on the particular implementation). It is noted that FIG. 5 depicts a cross-sectional side view of the deflection assembly 70, depicting upper 94 and lower 102 deflecting faces of the assembly 70. In this regard, for the state of the well of FIG. 5, the casing window 150 has been formed, and the tubing string 52 has been retrieved from the well, thereby leaving the deflection assembly 70 and the packer 54 (not depicted in FIG. 5) downhole. In general, the deflection assembly 70 includes an outer whipstock 80 and a lateral deflector 90 that is initially nested inside the whipstock 80; the whipstock 80 guides the trajectories of the mills 56, 58 and 60 and remains downhole for purposes of guiding the trajectory of a drill string 100 to drill a lateral wellbore 130; and the lateral deflector 90 is thereafter used for purposes of guiding the trajectory of a liner as the liner enters the lateral wellbore.

More specifically, in accordance with some implementations, the drill string 100 includes a bottom hole assembly (BHA), which contains, in turn, a drill bit assembly 134 for purposes of drilling the lateral wellbore 130. In general, the drill bit assembly 134 is guided, or directed, into the casing window 150 via a deflecting surface, such as the depicted inclined deflecting face 94, of the whipstock 80.

As depicted in FIG. 5, the whipstock 80 is hollow in that the whipstock 80 contains an internal cavity 106, which, in turn, contains the lateral deflector 90. In general, the outer surface of the lateral deflector 90 conforms to the inner profile of the whipstock 80 and also contains a deflecting surface, such as a deflecting face 102, which is aligned in the same orientation of the deflecting face 94 of the outer whipstock 80. The lateral deflector 90 also is hollow with an internal cavity 110 that is in fluid communication with the central bore, or passageway, of the tubing member that extends through the packer 54 (see FIG. 4, for example).

The deflecting faces 94 and 102 may have numerous profiles or shapes, depending on the particular implementation. For example, in accordance with some implementations, the face 94, 102 may be a "spoon-type" face that is curved and inclined relative to the longitudinal axis of the deflecting assembly 70. Regardless of its shape, the deflecting face 94, 102 is oriented to guide the mills, drill string and/or lateral liners toward the location of the depicted casing window 150. The whipstock 80 and the lateral liner 90 are used in different phases of the completion, as the whipstock 80 is first used and then removed from the well 10, leaving the lateral deflector 90 exposed for its function, as further disclosed herein.

Still referring to FIG. 4, after the lateral wellbore 130 has been drilled, the drilling string 10 is retrieved from the well 10. Moreover, a separate run may be made into the well 10 using an appropriate retrieval tool for purposes of engaging the whipstock 80 and retrieving the whipstock 80 from the well 10. In this regard, in accordance with implementations disclosed herein, the whipstock 80 is releasably attached (via a releasable mechanism, such as a snap latch, a collet, shear screws, and so forth) to the inner-disposed lateral deflector 70.

Figure 6:
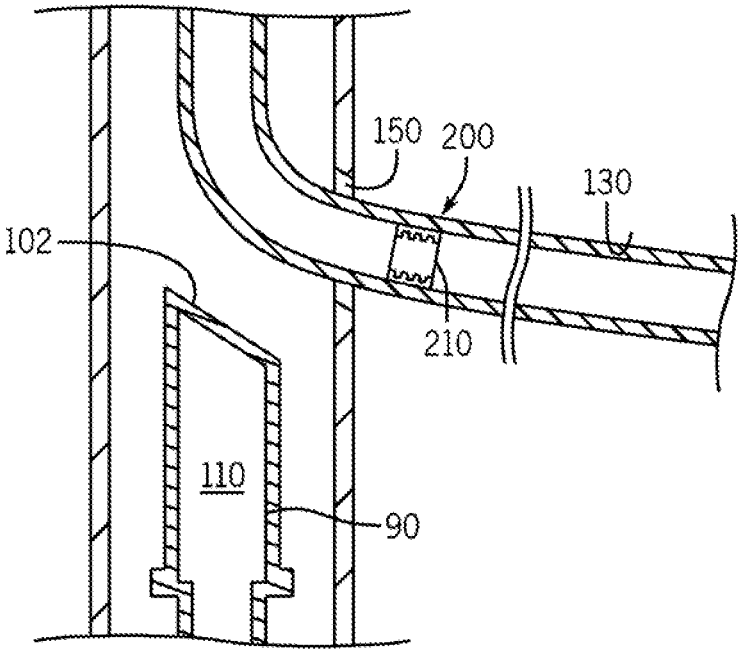
FIG. 6 is a schematic diagram illustrating installation of a liner in the lateral wellbore using the lateral deflector to guide the trajectory of the liner according to an example implementation.

Due to this arrangement, when the retrievable tool engages the whipstock 80 to cause its release from the lateral deflector 90 and retrieves the whipstock 80 from the well 10, the lateral deflector 90 remains in the well 10, still secured to the packer 54. Referring to FIG. 6, in this position, the lateral deflector 90 may be used for purposes of guiding a lateral liner string 200 that is subsequently run into the parent wellbore 20. In this manner, as depicted in FIG. 6, the deflecting face 102 of the lateral deflector 90 serves to guide the lateral liner 200 toward and through the casing window 150 and into the lateral wellbore 130, as the lateral liner 200 is being run downhole into the parent wellbore 20.

As depicted in FIG. 6, after the lateral liner 200 is installed in the lateral wellbore 130, the lateral deflector 90 remains below the lateral liner 200, where the lateral liner 200 extends into the parent casing 20. For purposes of establishing fluid communication between the region below the packer 54 (see also FIG. 4) and the region of the well 10 above the lateral deflector 90, a perforating operation may be performed in the well 10 for purposes of perforating the lateral deflector's deflecting face 102. In order to direct perforating charges to fire in the appropriate directions, the lateral liner 200 is installed with a perforating gun orientation device 210, a device that is constructed to engage a perforating string that is run into the liner 200 and orient both the depth and azimuth of a perforating gun of the string for purposes of directing the gun's perforating jets (when the gun is fired) into the deflecting face 102.

As an example, the orientation device 210 may be an index casing coupler (ICC), which is available from Schlumberger®. Other orientation devices may be used, in accordance with other implementations. Moreover, the orientation device may be run into the liner 200 after the liner 200 is installed, in accordance with further implementations. Additionally, in accordance with alternative implementations, a perforating gun may be run into the liner 200 and an orientation mechanism, other than an orientation device that is fixed to the liner 200 may be used for purposes of orienting the perforating gun's charges. For example, in accordance with some implementations, a weighted, gravity-based orienting mechanism of the perforating gun may be used to align the perforating charges to direct the perforating jets in the appropriate direction.

Figure 7:
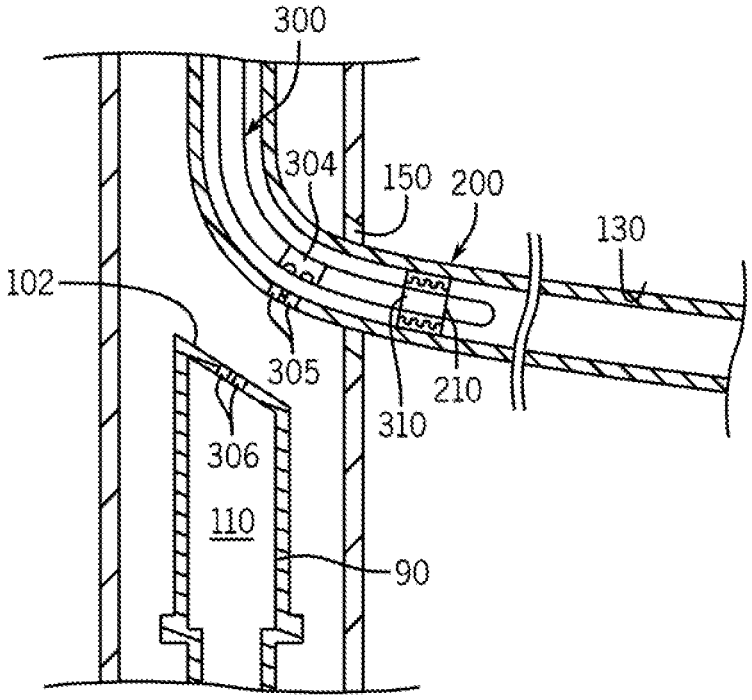
FIG. 7 is a schematic diagram illustrating an assembly and a technique to perforate a deflecting face of a lateral deflector according to an example implementation.

For implementations in which the orientation device 210 is used, FIG. 7 depicts a perforating string 300 that is run into the lateral liner 200 and which contains an orientation key 310 that engages the orientation device 210. Upon this engagement, perforating charges (shaped charges, for example) of a perforating gun 304 of the perforating string 30 become directionally aligned with the deflecting face 102 of the lateral deflector 200 such that the gun's perforating jets perforate both the lateral liner 200 (as indicated via perforation-produced openings 305 of FIG. 7) and the deflecting face 102 (as indicated by perforation-produced openings 306 of FIG. 7). Thus, after the perforating operation, the well fluid barrier that is otherwise present due to the lateral deflector 90 is breached, and fluid communication is established between the region of the well below the packer 54 and the region above the lateral deflector 90.

Other implementations are contemplated, which are within the scope of the appended claims. For example, in accordance with further implementations, the lateral deflector may be "pre-perforated," in that one or more communication paths may already be present in the deflecting face 116 when the lateral deflector 90 is run downhole with the whipstock 80. Thus, for these implementations, the perforating operation is not employed. As another variation, in accordance with some implementations, a jetting operation that uses abrasive fluid may be used for purposes of establishing communication through the deflecting face 116 of the lateral deflector 90. In this regard, a jetting tool may be run downhole inside the lateral liner and oriented via an orientation device, similar to the manner in which the perforating gun is oriented. Thus, many implementations are contemplated, and are within the scope of the appended claims.

Figure 2:
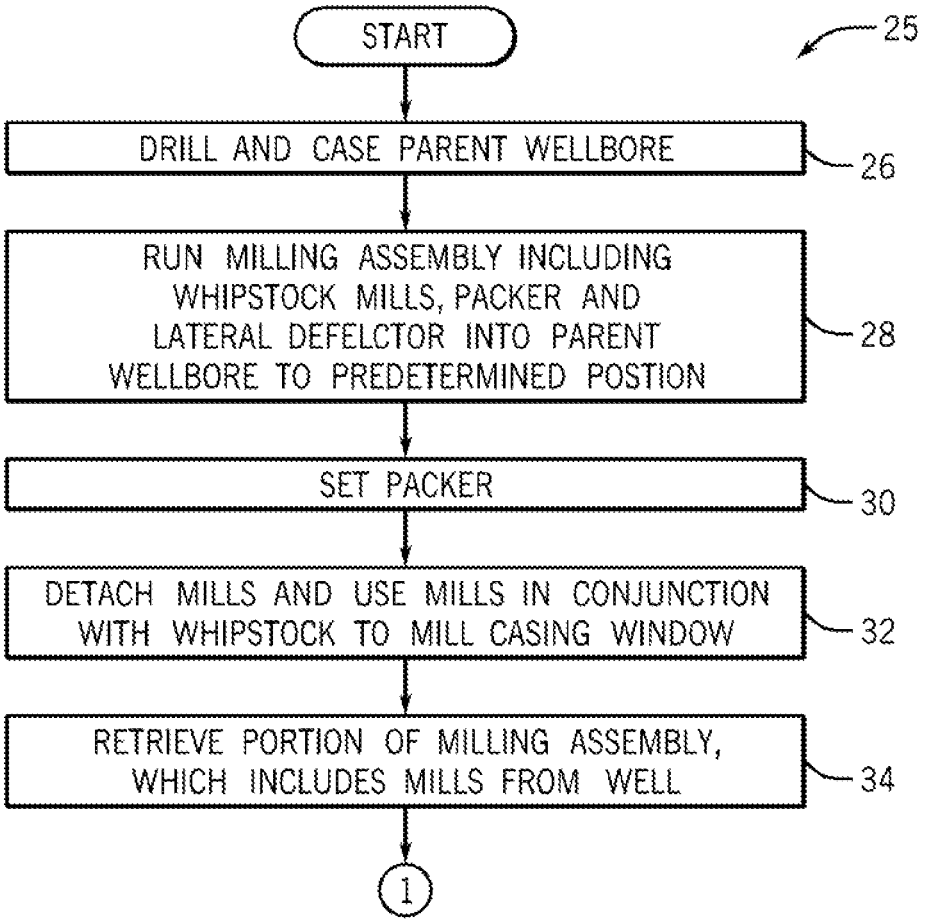
FIGS. 2 and 3 illustrate a flow diagram depicting a technique to complete a lateral wellbore of the multilateral well according to an example implementation.
Figure 3:
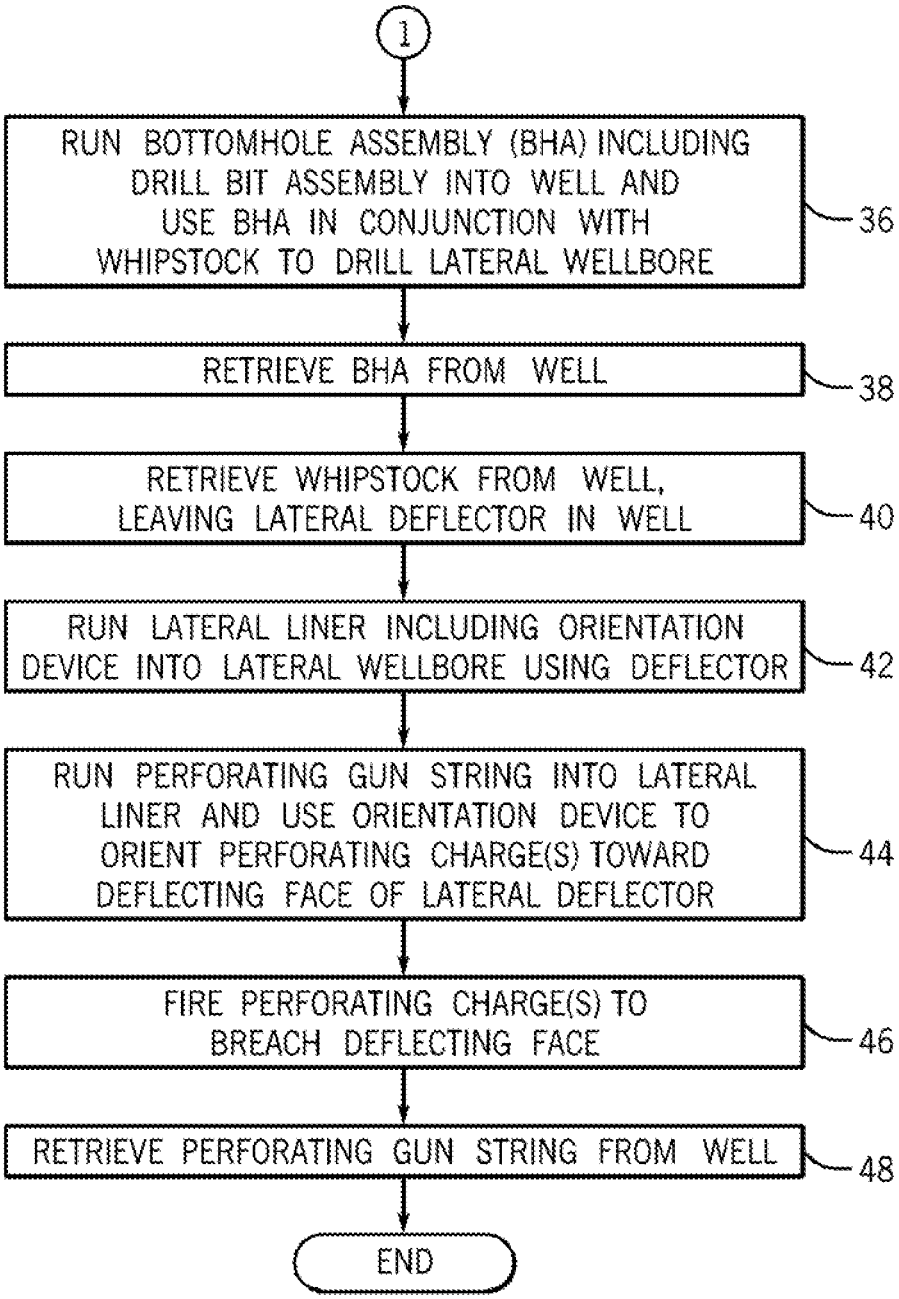

To summarize, for purposes of forming a multilateral completion (a TAML level 3 or level 4 multilateral completion, as examples), a technique 25 that is depicted in FIGS. 2 and 3 may be employed. Referring to FIG. 2, pursuant to the technique 25, a main, parent wellbore is first drilled and cased (as depicted in FIG. 1), pursuant to block 26. Next, a milling assembly, which includes a whipstock, mills, a packer and a lateral deflector is run into the main parent wellbore as a unit to a predetermined position in the parent wellbore, pursuant to block 28. The packer of the milling assembly is then set, pursuant to block 30.

The mills of the milling assembly are then detached (block 32) and used in conjunction with the whipstock to mill a casing window in the parent wellbore. The portion of the milling assembly, which corresponds to the mills is then retrieved from the well, pursuant to block 34.

Referring to FIG. 3, next, pursuant to the technique 25, a bottom hole assembly (BHA) is run into the well, where this BHA includes, a drill bit assembly that is used in conjunction with the whipstock to drill the lateral wellbore, pursuant to block 36. The BHA is then retrieved from the well, pursuant to block 38; and subsequently, a tool is deployed in the well to retrieve the whipstock from the well, leaving the lateral deflector in place, pursuant to block 40.

Thus, the lateral deflector and the packer remain in the well, pursuant to block 40. A lateral liner that includes an orientation device may then be run into the lateral wellbore using the lateral deflector to guide the installation of the liner, pursuant to block 42. Subsequently, a perforating gun may be run into the lateral liner such that the orientation device may be used to orient the perforating charges toward the deflecting face of the lateral deflector, pursuant to block 44. The perforating charges of the perforating gun may then be fired, pursuant to block 46, to breach the deflecting face of the lateral deflector; and then, the perforating gun string may be retrieved from the well, pursuant to block 48.

While a limited number of examples have been disclosed herein, those skilled in the art, having the benefit of this disclosure, will appreciate numerous modifications and variations therefrom. It is intended that the appended claims cover all such modifications and variations

What is claimed is:

1. A method comprising:

running an assembly comprising a packer, a whipstock, a milling tool assembly, and a lateral deflector connected to the packer as a single unit in a single trip into a casing string of a first wellbore of a well;

the milling tool assembly including a pilot mill, a gauge mill, and a reamer mill;

milling a casing window in the casing string during the single trip;

using the whipstock to guide at least a drill string to form a second wellbore through the casing window;

disengaging the whipstock from the assembly;

retrieving the whipstock from the well while leaving the lateral deflector in the well;

running a liner into the second wellbore, the running comprising guiding the liner using the lateral deflector; and perforating the lateral deflector while in the well to open fluid communication through the packer without removing the packer from the first wellbore.

2. The method of claim 1, further comprising;

using the whipstock to guide the milling tool assembly to form the casing window in the casing string that lines the first wellbore.

3. The method of claim 1, further comprising running a perforating gun downhole into the well to perforate a deflecting surface of the lateral deflector.

4. The method of claim 3, further comprising orienting the perforating gun based at least in part on an orientation mechanism of the gun that relies on gravity.

5. The method of claim 3, wherein running the liner into the second wellbore comprises running an orientation device with the liner into the second wellbore, the method further comprising using the orientation device to orient perforating charges of the perforating gun toward the deflecting surface.

6. The method of claim 1, wherein running the assembly comprises running a hollow whipstock body into the well and disposing the lateral deflector inside the hollow whipstock body.

7. The method of claim 1, wherein running the assembly comprises running a hollow lateral deflector body downhole.

8. The method of claim 1, wherein running the assembly comprises running the lateral deflector downhole having a deflecting surface and at least one pre-existing fluid communication perforation in the deflecting surface to enable fluid communication through the packer.

9. An apparatus, comprising:

an assembly comprising a packer, a whipstock, a milling tool assembly, and a lateral deflector connected to the packer adapted to be run downhole into a first wellbore of a well as a single unit in a single trip;

the milling tool assembly including a pilot mill, a gauge mill, and a reamer mill for milling a casing window in a casing of the well during the single trip;

wherein the whipstock guides at least a drilling string to form a second wellbore through the casing window;

wherein the whipstock is adapted to be disengaged from the lateral deflector downhole in the well to allow retrieval of the whipstock from the well while leaving the lateral deflector in the well;

wherein the lateral deflector guides a liner during installation of the liner into the second wellbore; and wherein the lateral deflector is constructed to be breachable while in the well to open fluid communication through the packer without removing the packer from the first wellbore.

10. The apparatus of claim 9, further comprising an orientation device disposed downhole in the well to orient a perforating gun such that when a charge of the perforating gun fires, the firing of the charge breaches a deflecting surface of the lateral deflector.

11. The apparatus of claim 9, wherein the whipstock comprises a body having an internal cavity, and the lateral deflector is disposed inside the cavity when the whipstock and the lateral deflector are run downhole as a unit.

12. The apparatus of claim 9, wherein the lateral deflector comprises a body having a hollow cavity and a deflecting surface to guide installation of the liner in the second wellbore.

13. The apparatus of claim 9, wherein the lateral deflector comprises a body having a hollow cavity and a deflecting surface to guide installation of the liner in the second wellbore, wherein the deflecting surface comprises at least one fluid communication path to establish fluid communication between the hollow cavity and a region of the well uphole of the lateral deflector when the lateral deflector is run downhole as a unit with the whipstock.

14. An apparatus usable within a casing of a well, comprising:

a string including a packer, a whipstock, a milling tool assembly, and a lateral deflector connected to the packer, the string adapted to be run downhole as a single unit in a single trip;

the milling tool assembly including at least a mill for milling a casing window in the casing during the single trip;

wherein the whipstock comprises a first surface to guide at least a drill to form a lateral wellbore through the casing window;

wherein the lateral deflector comprises a second surface to guide installation of a liner into the lateral wellbore; and wherein the lateral deflector is breachable while in the well to open fluid communication through the packer without removing the packer from the well.

15. The apparatus of claim 14, wherein the string further comprises at least a pilot mill and a reamer mill to be run downhole on the string with the whipstock and the lateral deflector for forming the casing window in the casing.

16. The apparatus of claim 14, wherein the packer anchors the string downhole at a predetermined location in the well for the lateral wellbore.

17. The apparatus of claim 14, wherein the whipstock comprises a body having an internal cavity and the lateral deflector is disposed inside the cavity when the whipstock and the lateral deflector are run downhole as a unit.

18. The apparatus of claim 14, wherein the lateral deflector comprises a body having a hollow cavity and a deflecting surface to guide installation of the liner.

19. An apparatus usable in a wellbore, comprising:

an assembly to be run into the well as a unit, the assembly comprising a packer, a milling tool assembly, a whipstock comprising an interior space, and a lateral deflector disposed at least partially in the interior space;

the milling tool assembly including a pilot mill, a gauge mill, and a reamer mill for milling a casing window in a casing of the wellbore during a single trip into the wellbore;

the whipstock disposed for directing a drilling string to create a second wellbore through the casing window;

wherein the lateral deflector comprises a deflecting surface to guide a trajectory of a liner into the second wellbore;

the lateral deflector releasably secured to the whipstock;

the whipstock releasable from the lateral deflector to allow the whipstock to be retrieved from the wellbore while the lateral deflector remains in the wellbore; and the lateral deflector breachable to communicate fluid through the packer in the wellbore.

20. The apparatus of claim 19, wherein the deflecting surface has a pre-existing opening to communicate the fluid.

21. The apparatus of claim 19, wherein the whipstock comprises a surface adapted to at least guide the drilling string when the whipstock is secured to the lateral deflector.

22. The apparatus of claim 19, wherein the lateral deflector is adapted to be nested inside the whipstock when the lateral deflector is secured to the whipstock.

23. The apparatus of claim 19, wherein the packer has an interior bore;

the packer adapted to spatially secure the lateral deflector and the whipstock in the well when the whipstock is secured to the lateral deflector;

the packer is adapted to spatially secure the lateral deflector in the well after the whipstock is released from the lateral deflector; and at least one opening in the packer allows the fluid to be communicated through the interior bore of the packer when the whipstock is released from the lateral deflector.

* * * * *